United States Patent [19]

Moritani et al.

[11] 4,218,871

[45] Aug. 26, 1980

[54] ELECTRONIC TIMER

[75] Inventors: Nakanobu Moritani; Hajime Oda; Toshihide Samejima, all of Tokyo, Japan

[73] Assignee: Kabushiki Kaisha Seikosha, Tokyo, Japan

[21] Appl. No.: 922,433

[22] Filed: Jul. 6, 1978

[30] Foreign Application Priority Data

Jul. 5, 1977 [JP] Japan ..... 52-80316

[51] Int. Cl.[2] ..... G04F 8/00; G04F 10/00

[52] U.S. Cl. ..... 368/109; 235/92 T; 368/98; 368/108; 368/101

[58] Field of Search ..... 58/39.5, 22.9, 145 D, 58/21.13, 38 R, 152 B, 19 R, 57.5 R; 340/323; 235/92 T

[56] References Cited

U.S. PATENT DOCUMENTS 3,789,195 1/1974 Meier et al. ..... 235/92 T 3,930,142 12/1975 Meier ..... 235/92 EV 4,047,375 9/1977 Wulff ..... 58/21.13

*Primary Examiner*—J. V. Truhe

*Assistant Examiner*—John B. Conklin

*Attorney, Agent, or Firm*—Robert E. Burns; Emmanuel J. Lobato; Bruce L. Adams

[57] ABSTRACT

An electronic timer includes a presettable counter for continuously counting clock pulses and which is controlled to selectively count to a desired time count and to continuously count from that desired time count. A storage device stores, upon actuation, a time count counted by the presettable counter. A detection output is produced when the presettable counter has completed the counting from the desired time count therein to a given time count. An alarm is generated in response to the detection output and is thereafter stopped. In response to the stopping of the alarm, the presettable counter is preset with the time count stored in the storage device. In this way the presettable counter is automatically set to an initial time count to enable repeated use without complication.

10 Claims, 2 Drawing Figures

ELECTRONIC TIMER

BACKGROUND OF THE INVENTION

Most of the conventional timers have a function for sounding a buzzer or the like by generating an output when a set time has elapsed. Such timers must always be set again to the required time. If a repeated lapse of predetermined time is needed, the configuration of the timer becomes very complicated.

SUMMARY OF THE INVENTION

The present invention relates to an electronic timer.

It is an object of the present invention to provide an electronic timer in which the contents of storage means and counting means are allowed to be mutually capable of transferring their contents to one another to actuate the timer repeatedly only by setting the required time once unless the set time of the timer, changes so that one may rapidly actuate the required time from the initial state even if the counting is stopped in the midst of counting.

It is another object of the present invention to provide an electronic timer in which the contents of storage means and counting means are allowed to be mutually capable of transferring their contents to one another to generate a sound when the time set in the counting means has elapsed and to automatically set the initial time set in the storage means into the counting means when the sound is stopped to thereby actuate the timer from the initial state without requiring the setting operation of the time.

It is still another object of this invention to provide an electronic timer which generates a sound at a predetermined time before the time set in the counting means is completely counted in order to recognize the coming of the predetermined time in advance.

BRIEF DESCRIPTION OF THE DRAWINGS

The nature of the invention, as well as other objects and advantages thereof, will become more apparent from consideration of the following detailed description and the accompanying drawings in which.

DESCRIPTION OF THE PREFERRED EMBODIMENTS

Figure 1A:
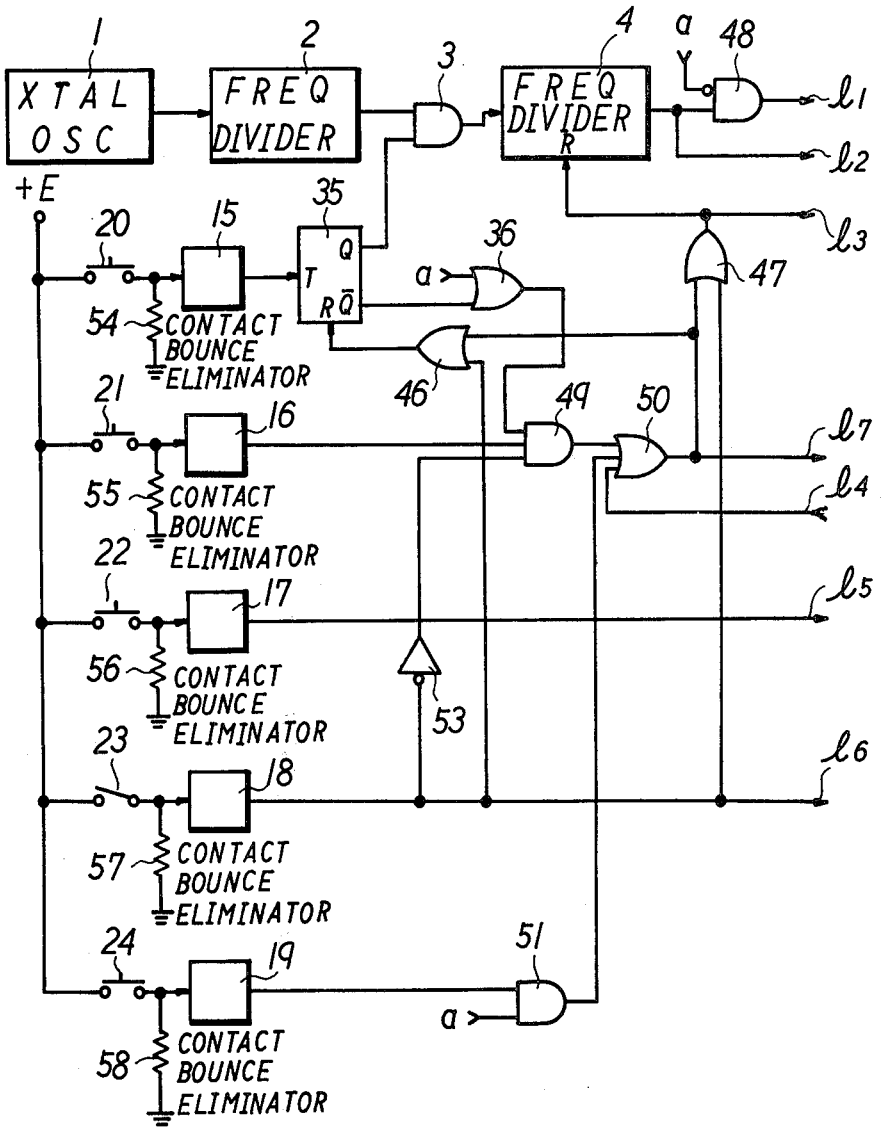
FIGS. 1A and 1B are block diagrams showing one preferred embodiment of the present invention.
Figure 1B:
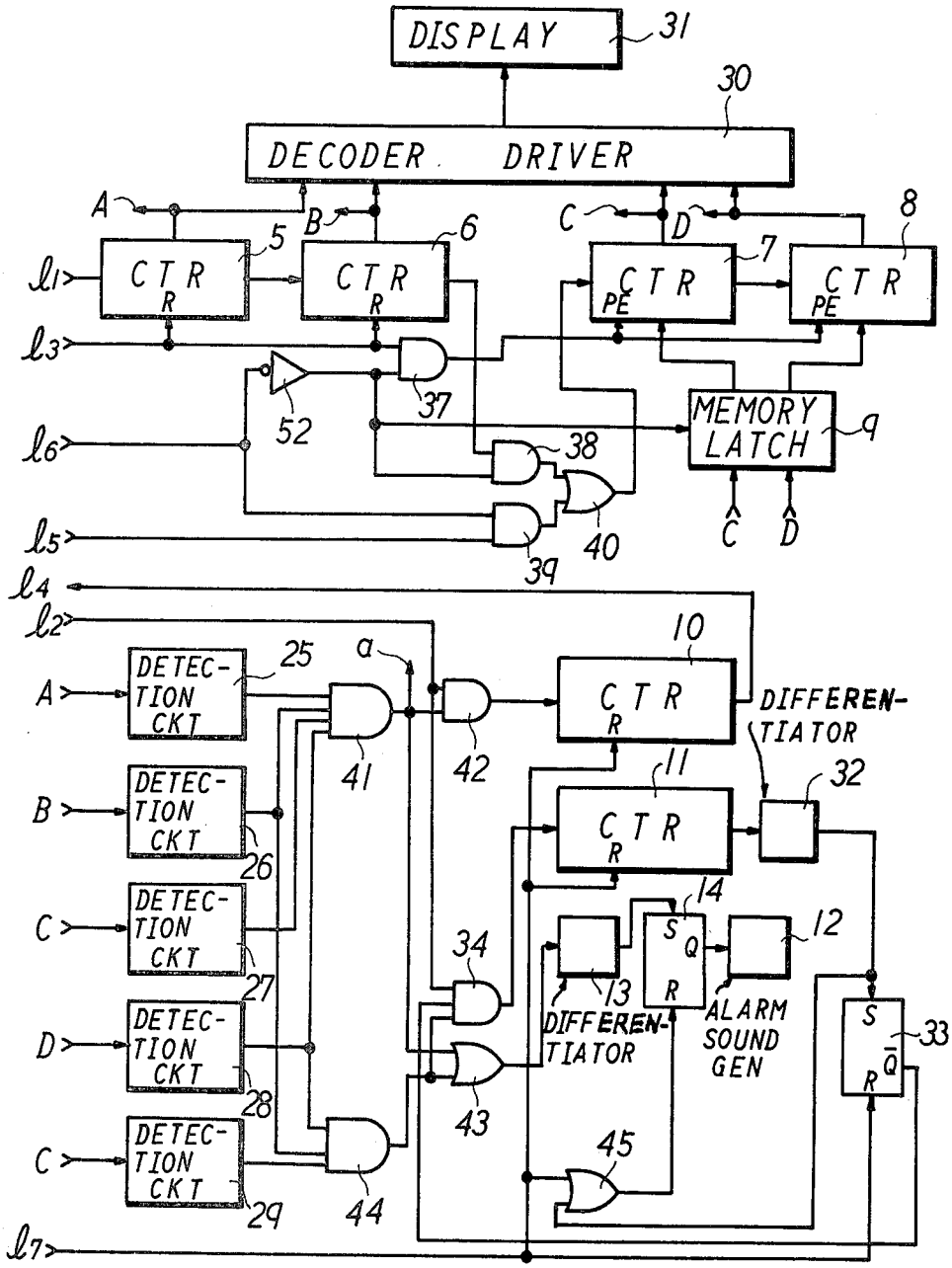

In FIGS. 1A and 1B, the output frequency of a crystal oscillator 1 is reduced by a frequency divider 2 and is further reduced to 1 Hz through an AND gate 3 by a frequency divider 4. A counter 5 down counts a first decimal seconds digit, and a counter 6 down counts a second sexenary seconds digit. Counters 7 and 8 are presettable and for down counting a first decimal digit and a second decimal digit, respectively for minutes. A memory latch 9 tentatively stores the counted data of the counters 7 and 8. A counter 10 produces an output when counting 30 seconds, and a counter 11 produces an output when counting 3 seconds. An alarm sound generator 12 generates an alarm sound when a flip-flop 14 is set by the differentiated output of a differentiator 13. Contact bounce eliminators 15 to 19 remove the electric vibration of the contacts of mechanical switches 20 to 24, respectively which occurred upon the opening or closing of the contacts of the switches 20 to 24, and are well known as being composed of a flip-flop or shift register or the like. A detection circuit 25 detects the output of the counter 5 and when the content of the counter 5 is a logic value "0", i.e., in the reset state and it produces a logic value "1". Detection circuits 26 to 28 respectively detect the outputs of the counters 6 to 8 and when the contents of the counters 6 to 8 are a logic value "0" and each produces a logic value "1". A detection circuit 29 also detects the output of the counter 7 and when the content of the counter 7 is a logic value "1", and it produces a logic value "1". A decoder driver 30 converts the counted output of the counters 5 to 8 to signals adapted to be indicated on a main display unit 31. A differentiator 32 differentiates the output of the counter 11 to set a flip-flop 33 and the output Q thereof is applied to one input of an OR gate 34. The outputs of a flip-flop 35 are triggered by an output from the contact bounce eliminator 15 and are supplied to inputs of the gates 3 and 36. Reference numerals 37 to 51 indicate gate circuits, 52 and 53 indicate inverters, and 54 to 58 indicate resistors.

The operation of the electronic timer thus constructed will now be described. The description will refer to the case where the desired time is set in the counters 7 and 8. When the switch 23 is closed, a logic value "1" is produced at the output of the switch 23 and is applied through the contact bounce eliminator 18 ($l_6$) to one input of the OR gate 46, which thereupon supplies it to the reset (R) terminal of the flip-flop 35, which is thereupon reset and supplies a logic value "0" to the other input of the AND gate 3 to close the gate 3. The logic value "1" from the eliminator 18 is also applied to one input of the OR gate 47, which thereupon supplies its output ($l_3$) to the frequency divider 4 and to the counters 5 and 6 to reset them. The logic value "1" from the eliminator 18 is also applied to the inverter 53, which, in turn, inverts it to "0", which is applied to one input of the AND gate 49 to close the gate 49, and is also applied to the inverter 52, which, in turn, inverts it to "0", which is applied to one inputs of the AND gates 37 and 38 to close the gates 37 and 38. The logic value "1" from the eliminator 18 is also applied at its output ($l_6$) to one input of the AND gate 39 to open the gate 39. Then, when the switch 22 is repeatedly opened and closed, pulses are produced at the output of the contact bounce eliminator 17 ($l_5$). These pulses are applied to one input ($l_5$) of the AND gate 39, which thereupon produces, in turn, output pulses, which are supplied through the OR gate 40 to the counter 7 to set the desired time in the counter 7. Assume, for example that 80 minutes are set in the counters 7 and 8. Then, when the switch 23 is opened, the output of the inverters 52 is inverted to a logic value "1" to allow the set data 80 of the counters 7 and 8 to be stored in the memory latch 9. When the switch 20 is then closed, the output from the contact bounce eliminator 15 is changed to a logic value "1" to trigger the flip-flop 35. Thus the output Q of the flip-flop 35 is changed to a logic value "1" to open the gate 3. Accordingly, the pulses of 1 Hz from the frequency divider 4 are supplied to the gate 48. In the normal state, the input a of the gate 48 is a logic value "0" as will be hereinafter obvious and thus the gate 48 is opened. Accordingly, the pulse of 1 Hz from the frequency divider 4 is supplied to the counter 5 to allow the counter 5 to down count. That is, when the first pulse is supplied, the counters 5 and 6 count 59 seconds, and the counters 7 and 8 count 79 minutes, and these counters count down every time a pulse is sequentially supplied thereto.

When the counters 5 to 8 count 80 minutes 00 second, that is, when the counted content of the counters 5 to 8 becomes 00 minute 00 second, their outputs A to D are detected by the detection circuits 25 to 28, which, in turn, produce their output logic values "1", which are applied to the respective inputs of the AND gate 41, which thereupon produces an output a which is a logic value "1", which is supplied through the OR gate 43 and differentiator 13 to the set (S) input of the flip-flop 14 to set the flip-flop 14. Thus, the flip-flop 14 changes its output Q to a logic value "1", which is applied to the alarm sound generator 12, which thereupon generates an alarm sound to inform the user of the lapse of the set time. The output a of the gate 41 closes the gate 48 to thus stop the supply of the pulse of 1 Hz to the counter 5. In addition, since the gate 42 is opened by the output a from the gate 41, pulses of 1 Hz from the frequency divider 4 are supplied to the counter 10. If the switch 20 is not closed at this time, an alarm is sounded for 30 seconds. After 30 seconds have elapsed, the output ($l_4$) of the counter 10 resets the frequency divider 4 and the counters 5, 6 through the gates 50 and 47 and further the flip-flop 35 through the gates 50 and 46 to close the gate 3. The above mentioned output of the gate 47 enables the counters 7 and 8 to preset through the gate 37 and the 80 minutes time, stored in the memory latch 9, are set therein.

Thus, the setting time is again set in the counters 7 and 8. Accordingly, when the switch 20 is again closed, the same operation as described above will be repeated.

As an alarm sound stop switch, switch 24 is closed when the alarm sound is generated, since the gate 51 is opened by the output a from the gate 41, the gate 51 produces the output of a logic value "1". The output resets the flip-flop 35 through the gates 50, 46 to close the gate 3. The output "1" from the OR gate 50 ($l_7$) is also supplied to the counters 10 and 11 and flip-flop 33 to reset them and is also supplied through the OR gate 45 to the reset (R) terminal of the flip-flop 14 to reset the flip-flop 14. The output from the OR gate 50 is also supplied through the OR gate 47 at its output ($l_3$) to the frequency divider 4 and counters 5 and 6 to reset them. The output from the gate 37 allows the counters 7, 8 to again set the setting time which the memory latch 9 stores. Accordingly, when the switch 20 is again closed, the same set time can be counted.

Similar resetting can also be effected when the switch 21 is closed. When the switch 21 is closed, a logic value "1" is supplied through the contact bounce eliminator 16, AND gate 49 and OR gate 50 to the one input of the OR gate 47, which thereupon produces its output "1" ($l_3$), which effects the same operation as described above to set the setting time in the counters 7 and 8.

Although omitted in the previous description, this embodiment of the present invention also has a function of generating a prenotice alarm sound to prenotice the coming of the set time one minute before the lapse of the entire set time. This function will now be described below. When 79 minutes have elapsed after starting counting, the contents of the counters 5 to 8 are at 1 minute, namely, the contents of the counters 5, 6, 8 are kept at 0 and that of the counter 7 at 1. Therefore the outputs A, B, D of the counters 5, 6, 8 are kept at a logic value "0" and the output C of the counter 7 at a logic value "1", so that each of the detection circuits 25, 26, 28, 29 produces a logic value "1" and the detection circuit 27 produces a logic value "0".

Accordingly, the gate 44 produces a logic value "1", which is supplied through the AND gate 43 and differentiator 13 to the set (S) input of the flip-flop 14 to set the flip-flop 14. Thus, the output Q of the flip-flop 14 becomes a logic value "1", thereby generating an alarm sound from the alarm sound generator 12. The output "1" of the gate 44 is also applied to one input of the AND gate 34. Since the output Q of the reset flip-flop 33 is applied to another input of the gate 34, the gate 34 is thus opened to supply the output pulse from the frequency divider 4 at its output ($l_2$) to the other input of the gate 34 and through the gate 34 to the counter 11. Thus, the counter 11 starts counting with the pulses of 1 Hz from the frequency divider 4. When 3 seconds have elapsed, the counter 11 produces its output, which is supplied through the differentiator 32, to set the flip-flop 33. Accordingly, the gate 34 is closed and the output from the differentiator 32 resets the flip-flop 14 through the gate 45, thereby stopping the alarm sound from the alarm sound generator 12.

Since the AND gates 51 and 49 are closed even if the switch 21 or 24 is closed during this prenotice alarm sound generating, the alarm will not stop before the end of 3 seconds.

It is desirable to have changing time of a player excluded from the playing time in a sport such as a basketball or the like. The operation of the timer for excluding such changing time from the playing time will be described below.

The desired time is preset in the counters 7 and 8 in the same manner as described above. When the switch 20 is then opened to start counting the time and is closed at the start of the time out during the game, a logic value "1" is supplied through the eliminator 15 to the flip-flop 35, which thereupon changes its output Q to logic value "0", which is applied to the AND gate 3 to close the gate 3. Accordingly, the pulse from the oscillator 1 is not supplied through the AND gate 3 to the frequency divider 4 and accordingly at its output ($l_2$) to the counters 5 to 8 to cause the counters 5 to 8 to retain the residual counted contents at the time of stopping counting. When the stopping time is over, the switch 20 is again closed to supply a logic value "1" to the flip-flop 35, which thereupon changes its output Q to "1", which is supplied to the AND gate 3 to open the gate 3. Accordingly, the pulse from the oscillator 1 is again supplied through the gate 3 and frequency divider 4 at its output ($l_2$) to the counters 5 to 8 to cause the counters 5 to 8 to start counting the residual time.

It is to be noted that, although the time is not set at the seconds digits in second in the counters 5 and 6 in the above embodiment, a memory latch constructed in the same manner as the memory latch 9 can be provided correspondingly for the counters 5 and 6 if it is necessary to set the time in the digits in the seconds counters. It also should be noted that up-down counters can be provided as the counters 7 and 8 to set the time in either up or down counting function.

Since the timer of the present invention resets to the initial state by transferring the time data of the storage means to the counting means by a manual switch in the foregoing description, it can save the labor to set the time repeatedly if the setting time is once set unless the setting time of the timer is changed. Since the counting means is reset to the initial state even if it is stopped in the midst of counting, it can be rapidly operated from the initial state when the timer is erroneously operated.

It should be noted that, if an alarm sound is generated to inform an alarm when the setting time has elapsed and a time is set in the counting means upon stopping of the alarm to automatically reset it to the initial state, the timer can be operated from the initial state without any operation after the alarm is stopped.

It is also to be noted that, if a sound is generated a predetermined time before the set time, the coming of predetermined time can be recognized in advance for its preparation. This is convenient particularly for a sport such as soccer, rugby, etc. which are limited in playing time.

What we claim is:

1. An electronic timer comprising:
pulse generating means for generating clock pulses;
a presettable counter for continuously counting the clock pulses;
first means for controlling the counting operation of said presettable counter to selectively count to a desired time count and to continuously count;
storage means for storing the time count counted by said presettable counter upon actuation;
detection means for producing a detection output when said presettable counter has completed the counting from the desired time count therein to a given time count;
alarm generating means for generating an alarm sound in response to the detection output;
stopping means for stopping the alarm sound; and
second means for presetting the time count stored in said storage means into said presettable counter in response to the stopping of the alarm sound.

2. An electronic timer according to claim 1, further comprising third means for producing a detection output when the presettable counter has been counted to a predetermined count before the given time count and fourth means for actuating the alarm generating means to generate the alarm sound for a relatively short time in response to the detection output of the third means.

3. An electronic timer according to claim 1, wherein the first means includes means for stopping the continuous counting of the presettable counter before it reaches the given time count and further comprising third means for presetting the time count stored in said storage means into said presettable counter when the counting operation of said presettable counter has been stopped prior to the given time count.

4. An electronic timer according to claim 1,
wherein the stopping means comprises a timer for producing an output when a predetermined time has elapsed from the start of the generating of the alarm sound and wherein the second means includes means for presetting the time data stored in said storage means into said presettable counter in response to the output of said timer.

5. In an electronic timer having means generating clock pulses, the improvement comprising: presettable counting means loadable both serially and in parallel; first means for selectively serially loading the counting means to obtain a desired count therein and to enable same to continuously count the clock pulses; actuatable storage means for parallel loading therein, upon actuation, the desired time count from the counting means; second means for producing a detecting signal upon the detecting of a predetermined time count in the counting means; third means for generating an alarm signal in response to the detecting signal; and fourth means responsive to the termination of the alarm signal to actuate the parallel loading of the time count stored in the storage means into the counting means.

6. The electronic timer according to claim 5; further comprising means for stopping the generation of the alarm signal by the third means, and wherein the fourth means is responsive to the termination of the alarm signal for effecting the loading of the counting means.

7. The electronic timer according to claim 6; wherein the stopping means comprises timing means for producing an output signal at a predetermined time from the beginning of the alarm signal, and wherein the fourth means is responsive to output signal of the timing means for loading the counting means.

8. The electronic timer according to claim 5; further comprising means for effecting the generation of the alarm signal by the third means upon the counting means reaching a given time count prior to the predetermined time count.

9. The electronic timer according to claim 5; further comprising means for producing a stop signal for terminating the continuous counting of the counting means prior to reaching the predetermined count, and wherein the fourth means is responsive to the stop signal for loading the contents of the storage means into the counting means.

10. The electronic timer according to claim 9; wherein the first means includes means for interrupting the continuous counting of the counting means without actuating the parallel loading of the contents of the storage means into the counting means.

* * * * *